United States Patent [19]

Dale

[11] Patent Number: 5,058,923

[45] Date of Patent: Oct. 22, 1991

[54] OSTEOLOGICALLY CORRECT SKI POLE

[76] Inventor: Hal J. Dale, 7 South Arizona, Dillon, Mont. 59725

[21] Appl. No.: 659,828

[22] Filed: Feb. 22, 1991

[51] Int. Cl.[5] ..... A63C 11/22

[52] U.S. Cl. ..... 280/821; 135/65; 280/824

[58] Field of Search ..... 280/809, 819, 821, 822, 280/823, 824; 135/65, 66, 77

[56] References Cited

U.S. PATENT DOCUMENTS

| | | | |
|---|---|---|---|
| 3,085,814 | 4/1963 | Scott | 280/821 |
| 3,436,090 | 4/1969 | Lange et al. | 280/11.37 |
| 3,582,100 | 6/1971 | Allsop | 280/11.37 B |
| 3,933,364 | 1/1976 | With | 280/11.37 D |
| 4,196,742 | 4/1980 | Owen, Jr. | 135/71 |
| 4,234,202 | 11/1980 | Loffelholz | 280/821 X |
| 4,620,723 | 11/1986 | Joseph | 280/821 |
| 4,787,652 | 11/1988 | Pronzati | 280/824 |
| 4,955,969 | 9/1990 | Jansson et al. | 280/824 |
| 4,958,650 | 9/1990 | Dale | 280/819 X |

FOREIGN PATENT DOCUMENTS

| | | | |
|---|---|---|---|
| 178317 | 9/1953 | Austria | 280/11.37 L |
| 1390129 | 1/1965 | France | 280/821 |
| 1519298 | 2/1968 | France | 280/819 |
| 2591908 | 12/1985 | France . | |
| 98588 | 4/1940 | Sweden | 280/11.37 D |
| 115448 | 11/1944 | Sweden | 280/11.37 P |
| 197805 | 3/1976 | Switzerland | 280/819 |

OTHER PUBLICATIONS

Cartoon entitled "History's Two Greatest Inventions were the Ski Pole and the Wheel".

*Primary Examiner*—Andres Kashnikow
*Assistant Examiner*—Michael Mar
*Attorney, Agent, or Firm*—John R. Flanagan

[57] ABSTRACT

An alpine skiing aid has a tapered, elongate rod with a lower snow or ice engaging tip end and an upper gripping end. The gripping end is canted forwardly so that the alignment of the user's wrist is in an osteologically correct position. The lower snow or ice engaging tip is canted backwardly to provide for a firmer, more secure hold in the snow or ice when planting the pole as a pivoting point around which to turn. The canting and bending of the rod are respectively defined by a first region of bend spaced below but adjacent to the upper gripping surface, and a second region of bend spaced above but adjacent to the lower surface engaging end.

6 Claims, 1 Drawing Sheet

OSTEOLOGICALLY CORRECT SKI POLE

BACKGROUND OF THE INVENTION

1. Field of the Invention

The present invention generally relates to an alpine skiing aid and, more particularly, is concerned with a ski pole that is osteologically and functionally correct.

2. Description of the Prior Art

Downhill skiers utilize ski poles to aid in making turns as well as maintaining balance. Downhill ski poles are generally carried with the tips above the surface of the snow until the skier wishes to "plant" the pole in order to facilitate a turn.

Unfortunately, ordinary ski poles have straight, elongate tubes or rods which when grasped by a person skiing force that person to change the natural wrist angle to be more in alignment with the pole and not in the natural alignment of the human bone structure. Further, straight poles will often employ inline pointed tips that allow only a straight line engagement with the snow or ice.

The lower extremity of the bones of the forearm including the ulna and radius are attached to the wrist joint at a particular angle so that, when the fingers of the hand grasp a pole, the longitudinal axis of the pole places the point of a straight elongate pole behind the user. In order to bring the point of a straight pole forward, so that it could be used as an improved aid in skiing, the wrist must be bent backwards to an angle that is both uncomfortable and unnatural for the condition of the human skeleton. Accordingly, a more natural position for a skiing aid is to have the handle or gripping surface canted forwardly approximately from 10 to 20 degrees.

It has been found by the inventor herein that if the ground engaging point were canted backwardly 10 to 20 degrees, then the point of the alpine skiing aid would maintain a firmer contact with the snow or ice than if it were not canted backwardly. This improves a skier's stability and balance in turning, for safety as well as quality of the turn. Thus, the ideal alpine skiing aid would provide a naturally occurring gripping surface while maintaining a ski pole in the correct osteological angle commensurate with the human skeleton and would provide for a backwardly projecting snow or ice engaging surface so that the device could be used to provide more stability over a longer duration of time.

As mentioned above, unfortunately, prior art ski poles are generally of the straight type. No ski poles are known in the prior art that provide a skiing aid having a naturally osteologically correct position of the gripping surface, that being forwardly canted while maintaining the snow or ice engaging point backwardly from the longitudinal axis of the main portion of the pole.

Consequently, a need exists for improvement of prior art ski poles used in alpine skiing.

SUMMARY OF THE INVENTION

The present invention provides an alpine skiing aid designed to satisfy the aforementioned need. The alpine skiing aid of the present invention provides not only an osteologically correct gripping end for aiding skiers but also firm snow or ice engaging contact. The skiing aid provides a simple, inexpensive device that can be utilized by downhill skiers. Further, the skiing aid is uncomplicated in design, easily repaired, not subject to damage by proper use, and simple to manufacture.

It is therefore a feature of the instant invention to provide a skiing aid having a forwardly angled upper gripping end.

It is another feature of the instant invention to provide a skiing aid having a backwardly projecting lower point.

These and other features and objects are attained according to the instant invention by providing an alpine skiing aid having an elongate rod with a gripping means on the upper end and a snow or ice engaging means on the lower end. The elongate rod is tapered toward the lower end. The upper end of the rod with the gripping means is canted forwardly and the lower end of the rod with the snow or ice engaging means is canted backwardly. The respective forwardly and backwardly cants of the upper and lower ends are provided by bending the tapered elongate rod at the appropriate positions along its length.

In its primary embodiment, the alpine skiing aid is provided with a cushion grip attached to the upper end of the elongate rod as well as a wrist engaging strap. The canting and bending of the rod are respectively defined by a first region of bend spaced below but adjacent to the upper gripping end, and a second region of bend spaced above but adjacent to the lower surface engaging end.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE PREFERRED EMBODIMENT

Figure 1:
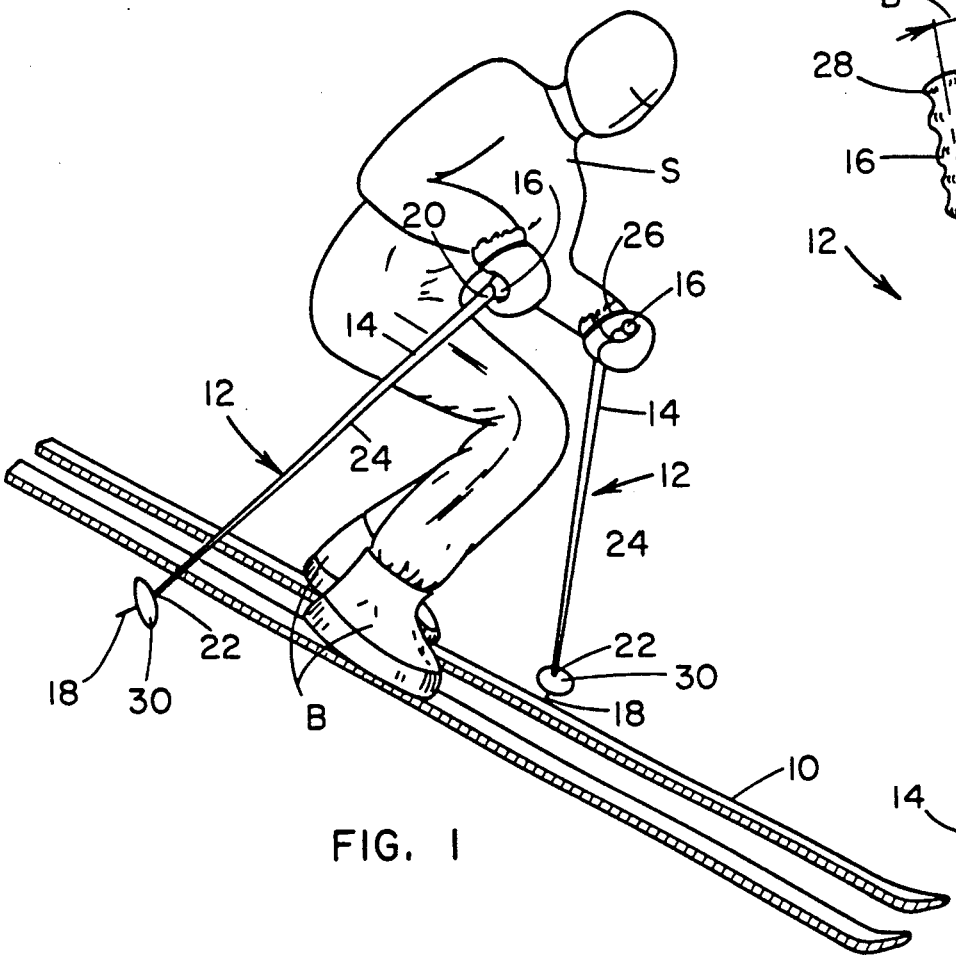
FIG. 1 is a perspective of a downhill skier employing a pair of the osteologically correct skiing aids of the present invention.

Referring to the drawings, and particularly to FIG. 1, there is illustrated a skier S standing on a pair of skis 10 to which boots B worn on the feet of the skier S are attached. The skier S is illustrated in the act of downhill, or alpine, skiing using a pair of osteologically correct skiing aids, or poles, 12 being constructed in accordance with the principles of the present invention.

Figure 2:
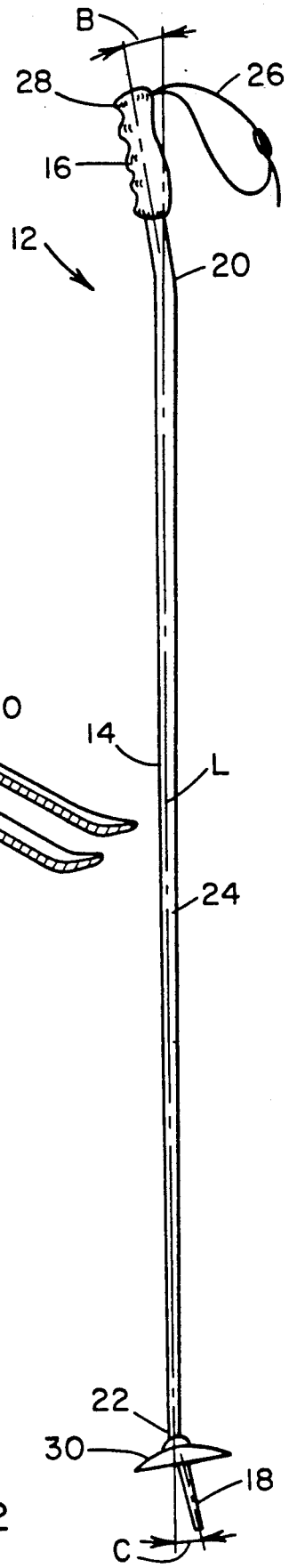
FIG. 2 is an enlarged side elevational view of one of the osteologically correct skiing aids of FIG. 1.

Referring also to FIG. 2, basically, each of the skiing aids 12, for use by the skier P in alpine skiing, is composed of an elongate tube or rod 14 with an upper gripping end 16 and a lower snow or ice engaging tip end 18. The rod 14 is tapered from the upper end 16 toward the lower end 18. Preferably, the rod 14 is made of aluminum tubing although it could also be made of plastic or fiberglass or any other suitable material.

As best seen in FIG. 2, the upper gripping end 16 is canted forwardly of and relative to a straight line L running longitudinally through the rod 14 so that the alignment of the skier's wrist is in an osteologically correct position. Also, the lower snow or ice engaging tip 18 is canted backwardly of and relative to the straight line L to provide for a firmer, more secure hold in the snow or ice when the skier is planting the skiing aid as a pivoting point around which to turn. Preferably, the upper handle or gripping end 16 is canted forwardly of the line L through an angle B of about 10 to 20 degrees, whereas the ground engaging point end 18 is canted backwardly of the line L through an angle C of about 10 to 20 degrees.

The respective forwardly and backwardly directed cants of the upper and lower ends 16, 18 are provided by bending the tapered elongate rod 14 at the appropriate positions along its length. The canting and bending of the rod 14 are respectively defined by a first region of bend 20 spaced below but adjacent to the upper gripping end 16, and a second region of bend 22 spaced above but adjacent to the lower surface engaging end 18. The upper and lower ends 16, 18 above and below the respective regions of bend 20, 22 along with the long intermediate portion 24 of the rod all lie in the same plane.

Further, in its preferred embodiment, the alpine skiing aid 12 is provided with a wrist engaging strap 26 and a cushion grip 28 attached to the elongate rod 14 at the upper gripping end 16. Also, a basket 30 is attached to the elongated rod 14 generally at the location of the second region of bend 22 above the lower surface engaging end 18.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. An osteologically correct skiing aid for use by a skier in alpine skiing, comprising:

a tapered, elongated rod with a substantially straight lower portion having a basket attached thereto and terminating at a lowermost snow or ice engaging tip, a substantially straight intermediate portion having a central longitudinal axis, and a substantially straight upper portion having a handgrip;

said upper portion being canted forwardly relative to the longitudinal axis of said intermediate portion and said lower portion being canted rearwardly relative to the longitudinal axis of said intermediate portion with said lowermost tip being located rearwardly of said longitudinal axis when said handgrip is held by a skier during skiing with said upper portion being angled in a forward direction of travel so as to provide an osteologically correct alignment of the skier's wrist;

said upper portion, said intermediate portion, and said lower portion of said rod all lying in the same plane.

2. The skiing aid of claim 1 wherein said upper portion of said rod is canted about 10 to 20 degrees forwardly of and relative to the longitudinal axis of said intermediate portion of said rod.

3. The skiing aid of claim 1 wherein said lower portion of said rod is canted about 10 to 20 degrees rearwardly of and relative to the longitudinal axis of said intermediate portion of said rod.

4. The skiing aid of claim 1 wherein said forwardly directed cant is defined by a region of bend spaced below but adjacent to said handgrip of said upper portion of said rod.

5. The skiing aid of claim 1 wherein said rearwardly directed cant is defined by a region of bend spaced above but adjacent to said snow or ice engaging tip of said lower portion of said rod.

6. The skiing aid of claim 5 wherein said basket is attached to said rod generally at the location of said region of bend above said snow or ice engaging tip of said lower portion of said rod.

* * * * *